US006231745B1

(12) United States Patent
Homley et al.

(10) Patent No.: US 6,231,745 B1
(45) Date of Patent: May 15, 2001

(54) CATHODE COLLECTOR BAR

(75) Inventors: Graham E. Homley, Export; Donald P. Ziegler, Lower Burrell, both of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/416,767

(22) Filed: Oct. 13, 1999

(51) Int. Cl.[7] ..... C25C 3/16
(52) U.S. Cl. ..... 205/374; 205/380; 204/243.1
(58) Field of Search ..... 205/374, 380; 204/243.1

(56) References Cited

U.S. PATENT DOCUMENTS

| | | | |
|---|---|---|---|
| 3,499,831 | 3/1970 | McMinn et al. | 204/243 |
| 3,551,319 | 12/1970 | Elliott | 204/243 |
| 4,795,540 | 1/1989 | Townsend | 204/243 R |
| 5,538,607 | 7/1996 | Pate | 204/280 |
| 5,597,461 | 1/1997 | Pate | 204/286 |
| 5,976,333 | 11/1999 | Pate | 204/279 |

*Primary Examiner*—Arun S Phasge

(74) *Attorney, Agent, or Firm*—Glenn E. Klepac; Douglas G. Glantz

(57) ABSTRACT

A novel electrolytic reduction cell apparatus and method are disclosed for the production of aluminum, including a copper insert inside the cathode collector bar. In one aspect, a melting allowance slot is provided. In one aspect, the copper insert resides in a slot in the collector bar, the slot having a width dimension of 0.001–0.009 inch (0.0025–0.00229 cm) or 0.1%–0.9% more than the dimension of the copper insert. In one aspect, the copper insert resides in a slot in the collector bar, the slot having a length dimension of 0.25–0.97 inch (0.635–2.5 cm) or 0.37–1.44% more than the dimension of the copper insert. In one aspect, the copper insert is located from a point proximate about 2 inches (5 cm) from the cell center to a point proximate about 69.35 inches (176 cm) from the cell center towards the first cell wall. In one aspect, the copper insert cross-section is about 0.042 to about 0.125 times the cross-sectional area of the cathode collector bar. A top plate is welded on the collector bar to contain the copper insert. In one aspect, a pressure relief means is provided. The apparatus and method of the present invention provide a novel means and method to redirect current in the Hall-Heroult cell to reduce or eliminate inefficiencies attributable to non-uniform electrical currents.

22 Claims, 7 Drawing Sheets

CATHODE COLLECTOR BAR

BACKGROUND OF THE INVENTION

1. Technical Field

This invention relates to electrolytic cells. In one aspect, this invention relates to cathode collector bars of electrolytic reduction smelting cells used in the production of aluminum.

2. Background

Aluminum is produced by an electrolytic reduction of alumina in an electrolyte. The aluminum produced commercially by the electrolytic reduction of alumina is referred to as primary aluminum.

Electrolysis involves an electrochemical oxidation-reduction associated with the decomposition of a compound. An electrical current passes between two electrodes and through molten $Na_3AlF_6$ cryolite bath containing dissolved alumina. Cryolite electrolyte is composed of a molten $Na_3AlF_6$ cryolite bath containing alumina and other materials, e.g., such as fluorspar, dissolved in the electrolyte. A metallic constituent of the compound is reduced together with a correspondent oxidation reaction.

Electrical current is passed between the electrodes from an anode to a cathode to provide electrons at a requisite electromotive force to reduce the metallic constituent which usually is the desired electrolytic product, such as in the electrolytic smelting of aluminum. The electrical energy expended to produce the desired reaction depends on the nature of the compound and the composition of the electrolyte.

Hall-Heroult aluminum reduction cells are operated at low voltages (e.g. 4–5 volts) and high electrical currents (e.g. 70,000–325,000 amps). The high electrical current enters the reduction cell through the anode structure and then passes through the cryolite bath, through a molten aluminum metal pad, and then enters a carbon cathode block. The electrical current is carried out of the cell by multiple cathode collector bars.

As the electrolyte bath is traversed by electric current, alumina is reduced electrolytically to aluminum at the cathode, and carbon is oxidized to carbon dioxide at the anode. The aluminum, thus produced, accumulates at the molten aluminum pad and is tapped off periodically. Commercial aluminum reduction cells are operated by maintaining a minimum depth of liquid aluminum in the cell, the surface of which serves as the actual cathode. The minimum aluminum depth is about 2 inches and may be 20 inches.

The alumina-cryolite bath is maintained on top of the molten aluminum metal pad at a set depth. The current passes through the cryolite bath at a voltage loss directly proportional to the length of the current path, i.e., the interpolar distance gap between the anode and molten aluminum pad. A typical voltage loss is about 1 volt per inch. Any increase of the anode to cathode spacing restricts the maximum power efficiency and limits the efficiency of the electrolytic cell operation.

Much of the voltage drop through an electrolytic cell occurs in the electrolyte and is attributable to electrical resistance of the electrolyte, or electrolytic bath, across the anode-cathode distance. The bath electrical resistance or voltage drop in conventional Hall-Heroult cells for the electrolytic reduction of alumina dissolved in a molten cryolite bath includes a decomposition potential, i.e., energy used in producing aluminum, and an additional voltage attributable to heat energy generated in the inter-electrode spacing by the bath resistance. This latter heat energy makes up 35 to 45 percent of the total voltage drop across the cell, and in comparative measure, as much as twice the voltage drop attributable to decomposition potential.

An adverse result from reducing anode-cathode distance is a significant reduction in current efficiency of the cell when the metal produced by electrolysis at the cathode is oxidized by contact with the anode product. For example, in the electrolysis of alumina dissolved in cryolite, aluminum metal produced at the cathode can be oxidized readily back to alumina or aluminum salt by a close proximity to the anodically produced carbon oxide. A reduction in the anode-cathode separation distance provides more contact between anode product and cathode product and significantly accelerates the reoxidation or "back reaction" of reduced metal, thereby decreasing current efficiency.

The high amperage electrical current passing through the electrolytic cell produces powerful magnetic fields that induce circulation in the molten aluminum pad leading to problems such as reduced electrical efficiency and "back reaction" of the molten aluminum with the electrolyte. The magnetic fields also lead to the unequal depths in the molten aluminum pad and the cryolite bath. The motion of the metal pad increases, sometimes violently stirring the molten pad and generating vortices, and causing localized electrical shorting.

Metal pad depth variations restrict the reduction of the anode to cathode gap and produce a loss in current efficiency. Power is lost to the electrolyte interposed between the anode and cathode blocks. Movement of the molten aluminum metal pad also causes uneven wear on the carbon cathode blocks and may result in early cell failure.

Metal pad turbulence also increases the "back reaction," or reoxidation, of cathodic products, thereby lowering cell efficiency. Metal pad turbulence accelerates distortion and degradation of the cathode bottom liner through attrition and penetration of the cryolite.

Molten aluminum metal pad stirring can be reduced by modifying the bus bar on an existing cell line to reduce the overall magnetic effects.

Whenever the anode-cathode distance is reduced, short circuiting of the anode and cathode must be prevented. In a conventional Hall-Heroult cell using carbon anodes held close to, but separated from, the molten aluminum metal pad, the shorting is caused by an induced displacement of the metal in the pad. Such displacement is caused in large part by the considerable magnetic forces associated with the electrical currents employed in the Hall-Heroult cell electrolysis. For example, magnetic field strengths of 150 gauss can be present in modern Hall-Heroult cells. This metal displacement can take the form of (1) a vertical, static displacement in the pad, resulting in an uneven pad surface such that the pad has a greater depth in the center of the cell by as much as 5 cm; (2) a wave-like change in metal depth, circling the cell with a frequency of 1 cycle/30 seconds; and (3) a metal flow with flow rates of 10–20 cm/second being common. To prevent shorting, the anode-cathode separation must be slightly greater than the peak height of the displaced molten product in the cell. In the case of aluminum production from alumina dissolved in cryolite in a conventional Hall-Heroult cell, such anode-cathode separation is held to a minimum distance, e.g., 4.0–4.5 cm.

Conventional electrolytic reduction smelting cells for the production of aluminum from alumina incorporate a pre-baked carbon anode structure suspended in the molten cryolite bath and an opposite molten aluminum metal pad cathode adjacent the cryolite bath. The molten aluminum metal pad collects on carbon blocks in the bottom of the cell and forms the liquid metal cathode adjacent the cryolite bath. The electrical current is conducted from the anode through the cryolite bath, then through the molten aluminum metal pad, and through the cathode blocks to the external electric bus bar of the cell.

In the conventional cathode today, multiple steel cathode collector bars extend from the external bus bars through each side of the electrolytic cell into the carbon cathode blocks. The steel cathode collector bars are attached to the cathode blocks with cast iron, carbon glue, or rammed carbonaceous paste to facilitate electrical contact between the carbon cathode blocks and the steel cathode collector bars.

The flow of electrical current through the aluminum pad and the carbon cathode follows the path of least resistance. The electrical resistance in a conventional cathode collector bar is proportional to the length of the current path from the point the electric current enters the cathode collector bar to the nearest external bus. The lower resistance of the current path starting at points on the cathode collector bar closer to the external bus causes the flow of current through the molten aluminum pad and carbon cathode blocks to be skewed in that direction. The horizontal components of the flow of electric current interact with the vertical component of the magnetic field, adversely affecting efficient cell operation.

In recognition of the adverse effects that horizontal current components have on cell efficiency, cell designs have been proposed which attempt to reduce the horizontal component of current by changing the basic design of the cathode collector bars. The proposals found in the literature, however, do not account for the practical necessity of preassembling cathode blocks onto the iron collector bars so that the carbon cathode blocks can be reassembled in the bottom of the cell. They also fail to provide designs which are amenable to safe handling by maintenance crews using heavy equipment such as cranes.

One prior aluminum reduction cell attempt to increase cell efficiency by reducing horizontal current components is found in modified connector bars, of a lighter gauge material than the collector bars, which are connected to the collector bars at points distant from the ends of the collector bars. The resistances of the connector bars operate to direct currents drawn from each corresponding collector bar section. The lighter gauge connector bars are weak because of the lighter gauge material used in the connector bars, and they require special conditions to be handled safely by workers and cranes during maintenance operations. Primary smelting facilities for the production of aluminum have hundreds of electrolytic cells with more than two hundred cells connected in series. Because of the large number of cells, cell maintenance is an ongoing operation involving numerous personnel and heavy equipment, such as cranes, to move the heavy carbon cathode blocks and cathode collector bars.

Modified current lead bars positioned perpendicular to the bottom of the electrolytic cell require passages through other portions of cell lining, i.e., through the concrete vault and/or the refractory and insulating brick layers. Such passage would be costly and at the same time create a direct leakage path out of the cell, for any liquid metal or bath that penetrated the cathode block during operation. Such leakage, because of its proximity to the bus, would cause severe damage, thus creating an extended and costly repair prior to the cell being returned to service.

Modified carbon blocks having different resistivities have been arranged such that blocks with higher resistivities are closer to the sides of the cell. This approach requires the use of multiple joints along the length of each composite cathode. These joints are filled or rammed with a carbonaceous paste often referred to as seam mix or ramming paste. The ramming paste is an unfired or green mixture of anthracite and pitch binder, that is rammed into place once the cathode blocks are set in position and then baked to its final consistency immediately prior to the addition of molten bath. Over time, rammed seams have proven to be more susceptible to bath and metal leakage in operation than the pre-baked cathode blocks. Any metal leakage in these block to block joints directly exposes the collector bar to molten metal which results in a shortened pot life. Another concern has been the integrity of the critical cathode block to collector bar joint in the system. Because of the nature of the construction, the cathode to collector bar joint is made by placing the collector bar in the pot, applying a jointing compound to the bar, and then lowering the block into position. Under these conditions, it is extremely difficult to maintain the high quality necessary in this joint and as a consequence, the performance of the pot can suffer.

Prior attempts to solve the current distribution problem in aluminum electrolytic reduction cells fail to provide a practical design which can be implemented without major capital expenditures, provide serviceable pot life, and which is safe to handle by maintenance operators using heavy equipment.

INTRODUCTION TO THE INVENTION

Existing Hall-Heroult cell cathode collector bar technology is limited to rolled or cast mild steel sections. The high temperature and aggressive chemical nature of the electrolyte combine to create a harsh operating environment. The high melting point and low cost of steel offset its relatively poor electrical conductivity. In comparison, potential metallic alternatives such as copper or silver have high electrical conductivity but low melting points and are high cost metals. Copper is used in the apparatus and process of the present invention because it provides a preferred combination of electrical conductivity, melting point, and cost. Other high conductivity materials could be used based on their combinations of electrical conductivity, melting point, and cost relative to the aluminum smelting process.

The electrical conductivity of steel is so poor relative to the aluminum metal pad that the outer third of the collector bar, nearest the side of the pot, carries the majority of the load, thereby creating a very uneven cathode current distribution within each cathode block. Because of the chemical properties, physical properties, and, in particular, the electrical properties of conventional anthracite cathode blocks, the poor electrical conductivity of steel had not presented a severe process limitation until recently.

Conventional cathodes contained either 100% Gas Calcined Anthracite (GCA) or 100% Electrically Calcined Anthracite (ECA). These cathode blocks had poor thermal shock resistance. These cathode blocks swelled badly under electrolysis conditions, i.e., under the influence of cathodic current, reduced sodium, and dissolved aluminum. These cathode blocks had poor electrical conductivity (relative to graphite). In their favor, these cathode blocks had low erosion or wear rates (relative to graphite).

To overcome the shortcomings of 100% anthracite cathodes, cathode manufacturers added an increasing proportion of graphite to the raw cathode block mix. A minimum of 30% graphite seems to be sufficient to avoid thermal shock cracking and to provide reasonable electrical properties and sodium resistance in most instances. Further additions up to 100% graphite aggregate or 100% coke aggregate graphitized at 2,300–3,000° C. provide preferred operating and productivity conditions.

As the graphite content or degree of graphitization increases, the rate at which the cathode blocks erode or are worn away increases.

In pursuit of economies of scale, aluminum smelting pots have increased in size as the operating amperage has increased. As the operating amperage has been increased, the percentage graphite in cathodes has increased to take advantage of improved electrical properties and further maximize production rates. In many cases, this has resulted in a move to graphitized cathode blocks.

The operation of the pot is most typically terminated when the aluminum metal is contaminated by contact with the steel collector bars. This can happen when the cathode to seam mix joints leak, when the cathode blocks crack or break because of thermal or chemical effects or the combined thermochemical effects, or when erosion of the top surface of the block exposes the collector bar. In the application of higher graphite and graphitized cathode blocks, the dominant failure mode is due to highly localized erosion of the cathode surface that exposes the collector bar to the aluminum metal.

In a number of pot designs, higher peak erosion rates have been observed for these higher graphite content blocks than for 30% graphite/ECA blocks or 100% ECA blocks. Operating performance is therefore traded for operating life.

There is a link between the rapid wear rate, the location of the area of maximum wear, and the non-uniformity of the cathode current distribution. The higher graphite content cathodes are more electrically conductive and as a result have a much more non-uniform cathode current distribution pattern and hence higher wear rate.

Accordingly, there is a need to develop and provide a more even cathode current distribution so that the cathode wear rate will be decreased, the pot life will be increased, and the operating benefits of the higher graphite cathode blocks can be realized.

It is an object of the present invention to provide a novel electrolytic reduction cell apparatus and method to obtain a more uniform cathode current distribution.

It is an object of the present invention to provide electrolytic reduction cell apparatus and method including a novel cathode collector bar.

It is an object of the present invention to provide electrolytic reduction cell apparatus and method including a novel cathode collector bar to obtain a more uniform cathode current distribution in the carbon cathode blocks which can be used with existing conventional cathode shells and external current buses.

It is an object of the present invention to provide electrolytic reduction cell apparatus and method including a novel cathode collector bar, including maintaining a controlled heat balance of the pot.

These and other objects of the present invention will become more apparent from reference to the Figures of the drawings and the detailed description which follow.

SUMMARY OF THE INVENTION

The apparatus and method of the present invention provide an electrolytic reduction cell for the production of aluminum, including a cell having a first cell wall, an opposite second cell wall, and a cell center between the first cell wall and the second cell wall; a first external bus bar adjacent the first cell wall; at least one anode supported between the cell walls; a carbonaceous cathode block positioned opposite the anode and extending between the cell walls; a cathode collector bar having a longitudinal axis positioned in electrical contact with the cathode block and extending from the first cell wall to at least near to the cell center and electrically connected to the first external bus bar; and a copper insert inside the cathode collector bar.

The apparatus and method of the present invention provide an electrolytic reduction cell for the production of aluminum, including a first cell wall, a second cell wall opposite the first cell wall, and a cell center between the first cell wall and the second cell wall; a first external bus bar external to the first cell wall; at least one anode; a carbonaceous cathode block positioned below the anode; a ferrous cathode collector bar positioned in electrically conductive contact with the cathode block, extending from the first cell wall to at least toward the cell center, and electrically connected to the first external bus bar; and a copper insert inside the cathode collector bar, the copper insert having a first portion spaced apart from an external end of the cathode collector bar toward the cell center and terminating at a first interior end between the first cell wall and the cell center. By ferrous is meant a ferrous steel, mild steel or low carbon steel.

The copper insert has a first portion extending from near the first cell wall toward the cell center approximately parallel to the cathode collector bar longitudinal axis and terminating at a first interior end between the first cell wall and the cell center. In one aspect, the copper insert resides in a slot in the collector bar, the slot having a length dimension larger than the length dimension of the copper insert.

A top plate is welded on the collector bar to enclose the copper insert.

The apparatus and method of the present invention provide a novel means and method to redirect current in the Hall-Heroult cell to reduce or eliminate inefficiencies attributable to non-uniform electrical current paths in the cathode blocks.

DETAILED DESCRIPTION

Figure 1:
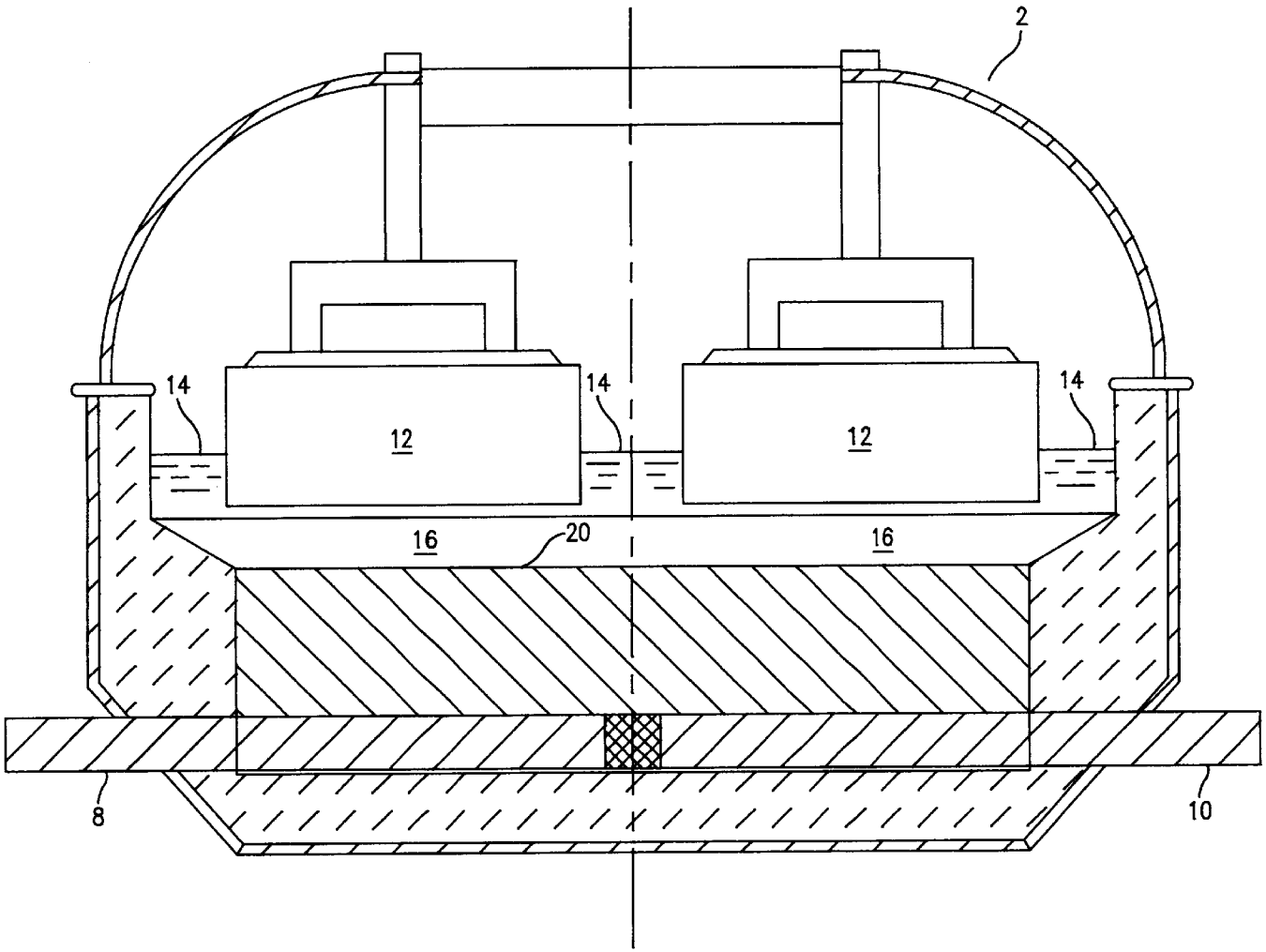
FIG. 1 is a schematic illustration in cross-section of a portion of an aluminum electrolytic reduction cell employing a conventional cathode collector bar having a solid, rectangular cross-section.

Our development efforts show cathode wear rate is linked directly to the cathode current distribution. High amperage pots develop severe localized wear at the ends of the cathode blocks.

Actual empirical examples have shown wear is linked to aluminum carbide formation. This reaction has also been shown to be non-selective with respect to the carbon type or source.

The wear rate is also influenced by the percent of aluminum carbide in the bath, undissolved alumina in the bath, dissolved aluminum metal, and bath velocity. The term "non-selective with respect to carbon type" means that, in side-by-side tests of graphite and anthracite samples, the wear rate is essentially the same for a given current density. The wear rate is influenced directly by current density. In the same series of tests, the wear rate increased as the current density was increased.

Higher graphite content cathodes have higher electrical conductivity as compared to 100% anthracite or low graphite content anthracite based cathodes. These higher graphite content cathodes have higher localized current densities and higher localized wear rates. The higher localized current densities and higher localized wear rates increase with increased graphite content. The higher localized current densities and the higher localized wear rates increase further with graphitized cathode blocks and increase further with increased graphitizing temperature.

Increasing the electrical conductivity of the collector bar achieves a more uniform cathode current distribution, reducing localized current density and wear rates. Copper has superior electrical conductivity but a low melting point, of about 1,085° C., with respect to the potential range of process temperatures that can be encountered in an operating pot.

In the apparatus and method of the present invention, a composite collector bar is created by including a copper insert as an integral part of the mild steel collector bar, i.e., by completely enclosing it in the mild steel structure. A slot is machined having sufficient tolerance to accommodate thermal expansion effects, and the slot then is covered with a steel plate, which is seal welded in place. A second slot of sufficient volume to accept an increased copper volume associated with melting, i.e., by way of example, of +4.9% by volume is used to accommodate any process event in which the collector bar temperature would exceed 1,085° C., e.g., for a pot temperature of approximately 1,120° C.

We have found that the composite collector bar of the apparatus and method of the present invention has preferred electrical properties. We have found that the composite collector bar of the apparatus and method of the present invention has enhanced thermal properties because of the inclusion of a novel copper insert of the present invention. We have found that an important part of the novel composite collector bar is to strike a balance between increased heat loss and the improved electrical properties which can be seen as a decreased cathode voltage drop. The novel composite collector bar of the apparatus and method of the present invention incorporates a restricted length of the copper insert toward the end closest to the external bus so as to control the quantity of heat lost and maintain a proper heat balance within the pot.

By significantly increasing the electrical conductivity of the collector bar, we have found that the cathode current distribution is much more uniform. The wear pattern of the cathode surface is more even, and the peak erosion rate is lower. The more uniform cathode current distribution increases the time required for the chemical/physical process of erosion to expose the collector bar and, in doing so, provides a longer pot life.

The increased pot life reduces the rate of spent pot lining generation, thereby saving disposal costs. The preferred cathode current distribution and preferred electrical conductivity of the novel composite collector bar of the apparatus and method of the present invention provides a lower overall cathode voltage drop, and the opportunity to operate at higher loads, and increased aluminum production for the same power input.

The apparatus and method of the present invention include providing an electrolytic reduction cell for the production of aluminum including two external walls. External bus bars are positioned adjacent to the two external cell walls, and at least one anode is supported in the cell between the cell walls. A carbonaceous cathode block is positioned below the anode and in association with other materials of construction, i.e., by way of example, refractory bricks, insulation, carbonaceous ramming paste, extends between the cell walls. A cathode collector bar having a top side, a bottom side, and a longitudinal axis is positioned in electrically conductive contact with the cathode block and extends from outside the first cell wall to within the cell, in one aspect to at least near the cell center.

The cathode collector bar is connected electrically to the external bus bar. The cathode collector bar has a copper insert positioned in the cathode collector bar. The copper insert extends from near the cell wall toward the cell center approximately parallel to the cathode collector bar longitudinal axis and terminates at a first interior end between the cell wall and the cell center.

The apparatus and method of the present invention provide specified cathode collector bars which minimize the horizontal electrical currents in the metal pad. The specified cathode collector bars of the apparatus and method of the present invention are incorporated into existing cell designs using standard carbon cathode blocks or carbon cathode blocks.

Referring now to FIG. 1, an electrical current flows through an aluminum reduction cell 2 having a pair of conventional cathode collector bars 8 and 10. The electrical current enters the cell through an anode 12, passes through the electrolytic bath 14 and a molten aluminum pad 16. The electrical current then enters the carbon cathode block 20 and is carried out of the cell by the cathode collector bars 8 and 10. Electrical current illustrated by lines 70 (FIG. 7) is non-uniform and is concentrated toward the end of the cathode collector bars 8 and 10 closest to the external bus (not shown).

The cathode collector bars 8 and 10 have a rectangular cross section and are fabricated from mild steel.

Figure 2:
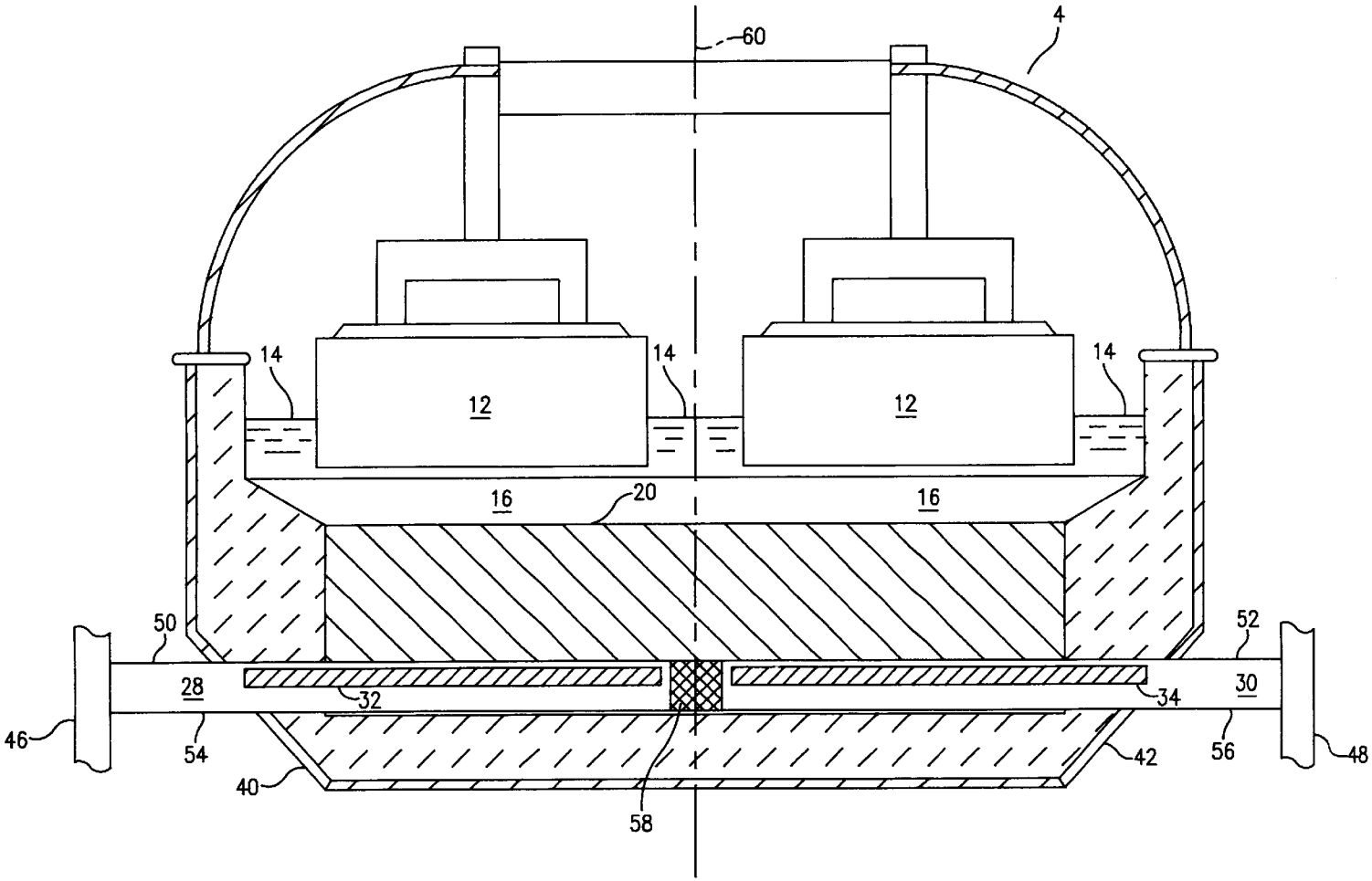
FIG. 2 is a schematic cross-sectional view of one embodiment of the cathode collector bar of the present invention installed in an aluminum reduction cell having a half width cathode collector bar.

Referring now to FIG. 2, a cathode block 20 provided by a single block of carbon extends across the full width of the pot 4. The cathode block 20 has two half-width cathode collector bars 28 and 30. Each cathode collector bar 28 and 30 extends to about the center-line 60 of the cathode block 20, and they are separated by a gap in the middle of the block. The gap can be filled by a crushable material or by a piece of carbon or even tamped seam mix or some combination 58.

Figure 3:
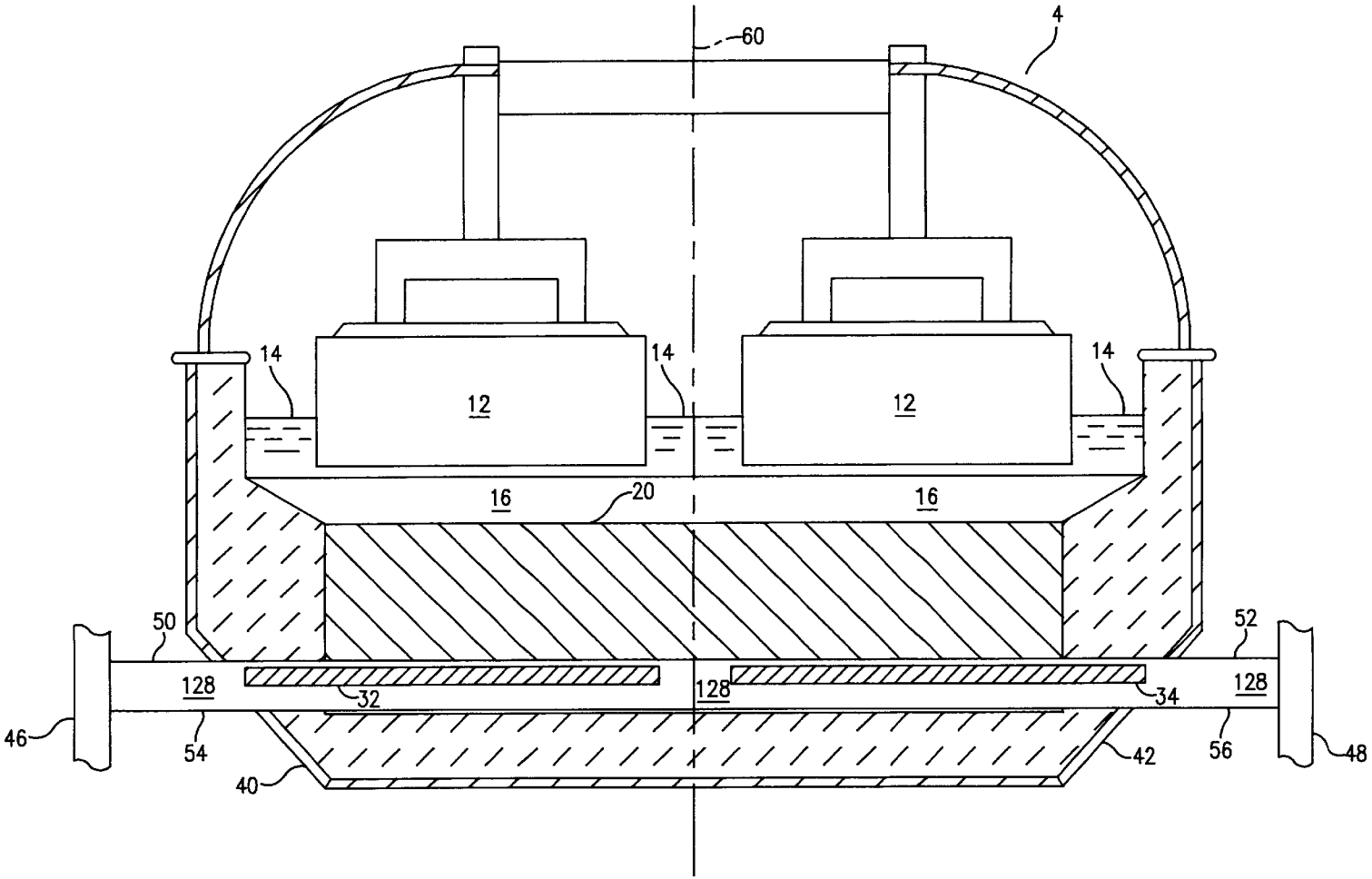
FIG. 3 is a schematic cross-sectional view of another embodiment of the cathode collector bar of the present invention installed in an aluminum reduction cell having a full width cathode collector bar.

Referring now to FIG. 3, a cathode block 20 is shown having a full width cathode collector bar 128.

Figure 4:
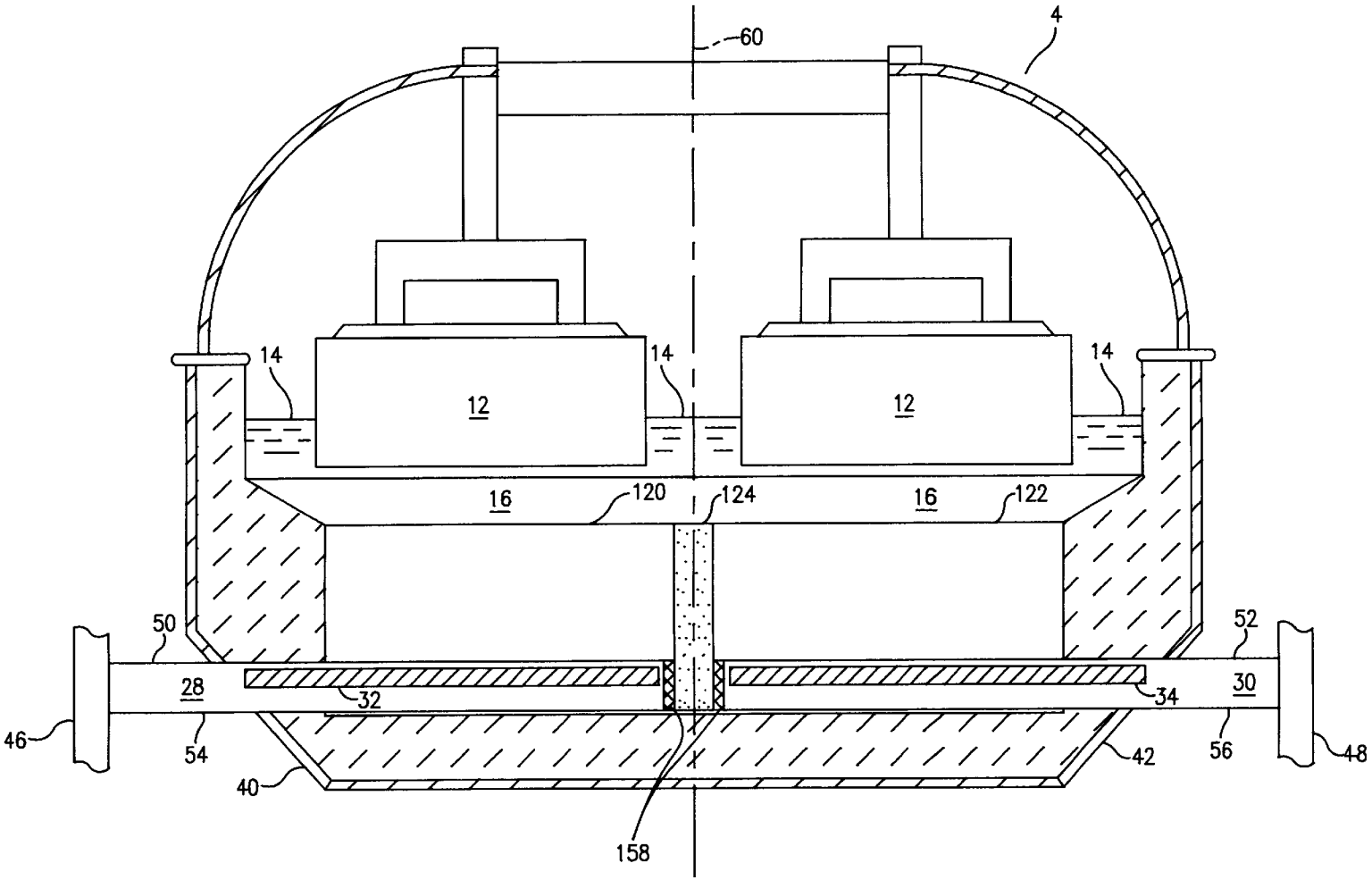
FIG. 4 is a schematic cross-sectional view of another embodiment of the cathode collector bar of the present invention installed in an aluminum reduction cell having half width cathode blocks.

Referring now to FIG. 4, a cathode block 120 and a cathode block 122 provide two half carbon blocks that are separated at the center line 60 of the pot by a thin joint of carbonaceous ramming paste 124. Each half width cathode block has one cathode collector bar 28 or 30. The gap between the end of the collector bar 28 or 30 and the thin joint of carbonaceous ramming paste 124 is filled by a crushable material or by a piece of carbon or even tamped seam mix or some combination 158.

The copper inserts of the present invention shown in various embodiments of the invention depicted in the figures of the drawings preferably are composed of a high conductivity grade of copper, preferably a deoxidized copper, e.g., such as oxygen-free grade copper which is 99.95%–99.99% copper.

The apparatus and method of the present invention include a novel electrolytic reduction cell 4 providing a cathode collector bar 28 and 30, or 128, having a copper insert 32 and 34, respectively, which directs the flow of current through the electrolytic reduction cell 4 in such a way as to minimize the horizontal components of the current flow. The apparatus and method of the present invention provide an electrolytic reduction cell for the production of aluminum, including a cell 4 having a first cell wall 40, an opposite second cell wall 42, and a cell center line 60 between the first cell wall 40 and the second cell wall 42. External bus bars 46 and 48 are provided adjacent the first cell wall 40 and the second cell wall 42. At least one anode 12 is supported between the cell walls 40 and 42. A carbonaceous cathode block is positioned opposite the anode 12 and in association with other materials of construction, i.e., by way of example, refractory bricks, insulation, carbonaceous ramming paste, extends between the cell walls 40 and 42. A single full width collector bar 128 or a pair of cathode collector bars 28 and 30, each having a top side 50 and 52, a bottom side 54 and 56, and a longitudinal axis positioned in electrically conductive contact with the cathode block, extends from outside the cell walls 40 and 42 to at least near the cell center line 60. The collector bars 28, 30, or 128 are electrically connected to the external bus bars 46 and 48. Copper inserts 32 and 34 are provided inside the cathode collector bars 28 and 30, respectively, or 128.

Figure 5:
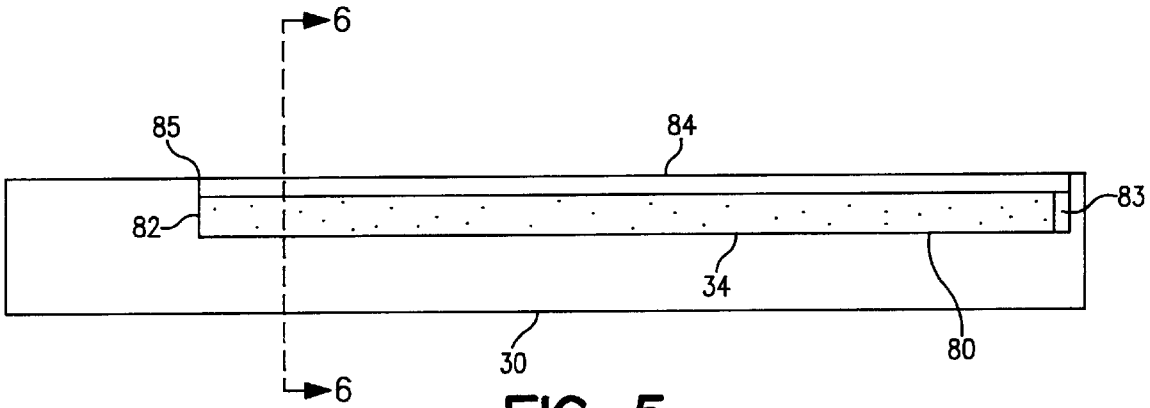
FIG. 5 is a schematic cross-sectional view of an embodiment of the cathode collector bar of the present invention illustrated in FIG. 2.
Figure 6:
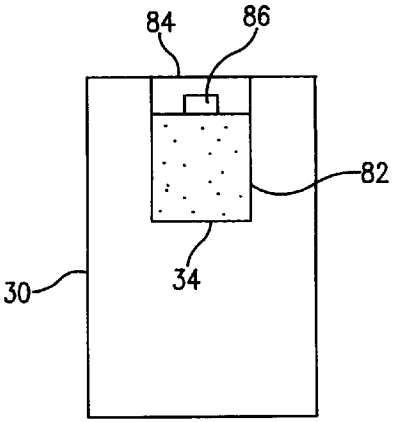
FIG. 6 is a schematic cross-sectional view taken along line 6—6 of FIG. 5.

Referring now to FIGS. 5 and 6, copper inserts 32 and 34 are formed in the cathode collector bars 28 and 30 by machining a slot 80 having sufficient tolerance to accommodate thermal expansion effects, and the slot 80 then is covered with a steel plate 84, which is seal welded in place. A melting allowance slot 86 has sufficient volume to accept an increased copper volume associated with melting, i.e., by way of example, of +4.9% by volume, and to accommodate any process event in which the collector bar temperature would exceed 1,085° C., e.g., for a pot temperature excursion above approximately 1,120° C.

Referring to FIGS. 5 and 6, copper inserts 32 and 34 are formed in the cathode collector bars 28 and 30 by machining a square sided slot. The square sided slot is 1.004" (2.55 cm) wide by 1.5" (3.81 cm) deep by 68" (172.72 cm) long to accept a square sided copper section 1" by 1" (2.54 cm) by 67.35" (171.07 cm) in length. The slot and copper insert then are covered with a steel plate 84 of 0.5" (1.27 cm) thickness, which is seal welded in place. A pressure relief hole 85 is provided and defined by the top plate 84, the top plate weld, and the cathode collector bar. The pressure relief is located in the coldest part of the copper insert and is located in the part of the cathode collector bar that extends beyond the cathode block towards the external bus bar. The slot width is controlled to ±0.001" (0.0025 cm) or ±0.1% of the slot width, and the slot depth is controlled to +0.01"/−0.0" (+0.0254/−0.0 cm) or +0.7%/−0.0% of the slot depth to accept the copper section of +0.002"/−0.004" (+0.0051/−0.0102 cm). These specifications provide for a tolerance of 0.001–0.009" (0.0025–0.0229 cm) or 0.1–0.9% of the copper section in the width direction. The tolerance in the vertical direction is less precise. Thermal expansion is provided for in the placement and welding of the 0.5" (1.27 cm) cover plate. The longitudinal thermal expansion allowance 83 is 0.25–0.97" (0.635–2.464 cm) or 0.37–1.44% of the copper section length and is strategically placed at the end of the collector bar closest to the center line of the pot.

The vertical ends of the copper section are shaped to conform to the vertical contour at the ends of the machined slot. The slot is then cleaned to remove any debris or machining fluids. The copper section is installed so that it is in good contact with the bottom of the slot as well as the vertical end 82 of the slot at the end of the collector bar that will extend out of the potshell. It will be necessary to use a combination of moderate pressure, collector bar preheat and cooling of the copper insert to ensure that the copper section is correctly positioned.

A top plate 84 is welded on the collector bars 28 and 30 to enclose the copper insert. The welding is conducted by standard techniques to minimize induced thermal stress concentration and bending of the collector bar.

As shown in FIG. 2, the copper inserts 32 and 34 extend horizontally into the cathode collector bars 28 and 30, which are in contact with the carbon cathode block 20. The copper inserts 32 and 34 extend parallel to the longitudinal axis of the cathode collector bars 28 and 30 in the center of the top face of the cathode collector bars 28 and 30. The copper inserts 32 and 34 preferably extend in the center of a width dimension of the cathode collector bars 28 and 30. The copper inserts 32 and 34 preferably have a length dimension to ensure a maximum enhancement of current collection but minimize the potential for exposing the copper insert to process chemicals traveling or percolating through the cathode blocks. The copper inserts 32 and 34 extend toward the nearest end of the cathode collector bars 28 and 30 connected to an external bus 46 and 48.

The copper inserts 32 and 34 range in size and shape, and include, by way of example, a 1 inch×1 inch (2.5 cm×2.5 cm) square. In one embodiment, the copper inserts 32 and 34 include 2 to 6 square inches (12.9–38.7 square cm) of copper in a mild steel bar of 9 to 40 square inches (58–258 square cm). In another embodiment, the copper inserts 32 and 34 are round and extend parallel to the longitudinal axis of the mild steel bar. In another embodiment, the collector bar is constructed from standard mild steel sections and standard copper sections that are pre-assembled and seal welded together to produce a mild steel collector bar with a square, round, or rectangular copper insert. In another embodiment, the mild steel collector bars 28 and 30 are machined or drilled at the centroid of the cross section of the mild steel bar to accept either a square or round copper insert 32 and 34 that extends parallel to the longitudinal axis of the mild steel collector bar. In the various embodiments, the method of manufacture and assembly will change.

The copper inserts 32 and 34 can range in size and shape, but preferably have a width at least equal to 1 inch (2.5 cm) within a width of the collector bars 28 and 30 having a width dimension of about 4 inches (10 cm). The copper inserts 32 and 34 preferably have a vertical height of at least about 1 inch (2.5 cm), preferably within a height for the collector bars 28 and 30 having a height dimension of about 6 inches (15 cm).

The vertical portion of the copper inserts 32 and 34, which defines the position of the end of the horizontal copper insert portion closest to the center of the cell, is located from about ¾ to about 49/50 of the distance and is preferably located from 45/50 to 49/50 of the distance from the end of the cathode block closest to the external bus system, to the center of the cell.

The copper insert has a first portion extending from near the center line toward the first cell wall approximately parallel to the cathode collector bar longitudinal axis and terminating at a first exterior end between the outer end of the cathode block and the end of the collector bar closest to the external bus 46 and 48. In one aspect, the copper insert resides in a slot in the collector bar, the slot having a length dimension of about 0.65 inches (1.7 cm) or 1% more than the length dimension of the copper insert. In one aspect, the copper insert extends about 15 inches (38 cm) from the outer end of the collector bar and stops about 0.65 inches (1.7 cm) from the end of a slot, at room temperature, which in turn stops about 1 inch (2.5 cm) from the end of the collector bar. In one aspect, the copper insert portion is located about 1.25 inches (3.18 cm) from the cell center to about 10 inches (25.4 cm) from the cell center toward the cell wall. In one aspect, the copper insert extends from about 1.65 inches (4.2 cm) to about 69 inches (175.26 cm) the distance from the inner end of the collector bar near the center line of the cell towards the end of the collector bar closest to the external bus. The copper insert is about 0.042 times the cross-sectional area of the cathode collector bar. In one aspect, the copper insert is about 0.084 times the cross-sectional area of the cathode collector bar. In one aspect, the copper insert preferably is between about 0.042 and 0.125 times the cross-sectional area of the cathode collector bar. In one aspect, the copper insert is between about 0.042 and 0.250 times the cross-sectional area of the cathode collector bar.

The copper insert slot starts 1 inch (2.5 cm) in from the inner end of the bar that is near the center line of the cell. The slot stops 15 inches (38 cm) in from the outer end of the bar that is connected to the bus. The copper insert is 0.65 inch (1.7 cm) shorter to allow for thermal expansion between room and operating temperature. The 0.65 inch (1.7 cm) expansion allowance is on the inner end of the bar which is approximately at the center of the cathode block.

In one embodiment, the cathode block 20 makes electrical contact with four "half-width" collector bars located by pairs in two different slots and are separated in the middle of the block by crushable Kao-wool. In one embodiment, a full-width cathode collector bar extends a distance entirely across the cathode block.

In one embodiment, the cathode block 20 is made of petroleum coke and pitch binder and baked to 2300–3000° C. to graphitize the material.

In one embodiment, the cathode block 20 is composed of 30% graphite aggregate, 70% electrically calcined anthracite aggregate bound together with pitch binder and baked to a nominal 1150° C.

In one embodiment, the cathode block 20 is composed of a mixture of 0–100% graphite aggregate, 100–0% electrically calcined or gas calcined anthracite aggregate bound together with pitch or another suitable binder and baked to a nominal 1150° C.

In the embodiment as shown in FIG. 2, a cathode block is used in conjunction with two cathode collector bars 28 and 30 having two copper inserts 32 and 34. The carbon block 20 electrically contacts the cathode collector bars.

The cathode block 20 is joined to the cathode collector bars 28 and 30 by a highly conductive material such as cast iron, carbonaceous glue, or rammed carbonaceous paste, preferably cast iron or carbonaceous glue.

The apparatus and method of the present invention reduce energy consumption without sacrificing the strong beam unit of cathode blocks that may be safely handled by cell maintenance crews. The novel cathode collector bar of the apparatus and method of the present invention reduce energy consumption and create a more uniform current distribution between the molten aluminum pad and the cathode blocks. The apparatus and method of the present invention overcome problems associated with conventional cell designs wherein the electrical current is non-uniform and concentrated toward the outer end of the cathode blocks, causing large horizontal electrical currents in the aluminum pad, high localized current densities, high localized erosion rates, and reduced operating life. The apparatus and method of the present invention overcome problems associated with conventional cell designs wherein the electrical current is non-uniform toward the outer end of the cathode blocks, causes large horizontal electrical currents in the aluminum pad, potentially violent stirring of the pad, generation of vortices, and localized shorting of the pad.

The horizontal portion of the copper inserts 32 and 34 extends from near the inner end of the collector bars 28 and 30 closest to the center line 60 of the cell to a point within the collector bar near to the cell walls 40, 42. In another embodiment, the horizontal portion of the copper inserts 32 and 34 extends from near the inner end of the collector bars 28 and 30 closest to the center line 60 of the cell to some point near to the end of the cathode block 20 closest to the external buses 46 and 48. In another embodiment, the horizontal portion of the copper inserts 32 and 34 extends from near the inner end of the collector bars 28 and 30 closest to the center line 60 of the cell to a point within the collector bar that is between the outer cell walls 40, 42 and the end of the collector bars 28 and 30 nearest to the external buses 46 and 48.

Figure 7:
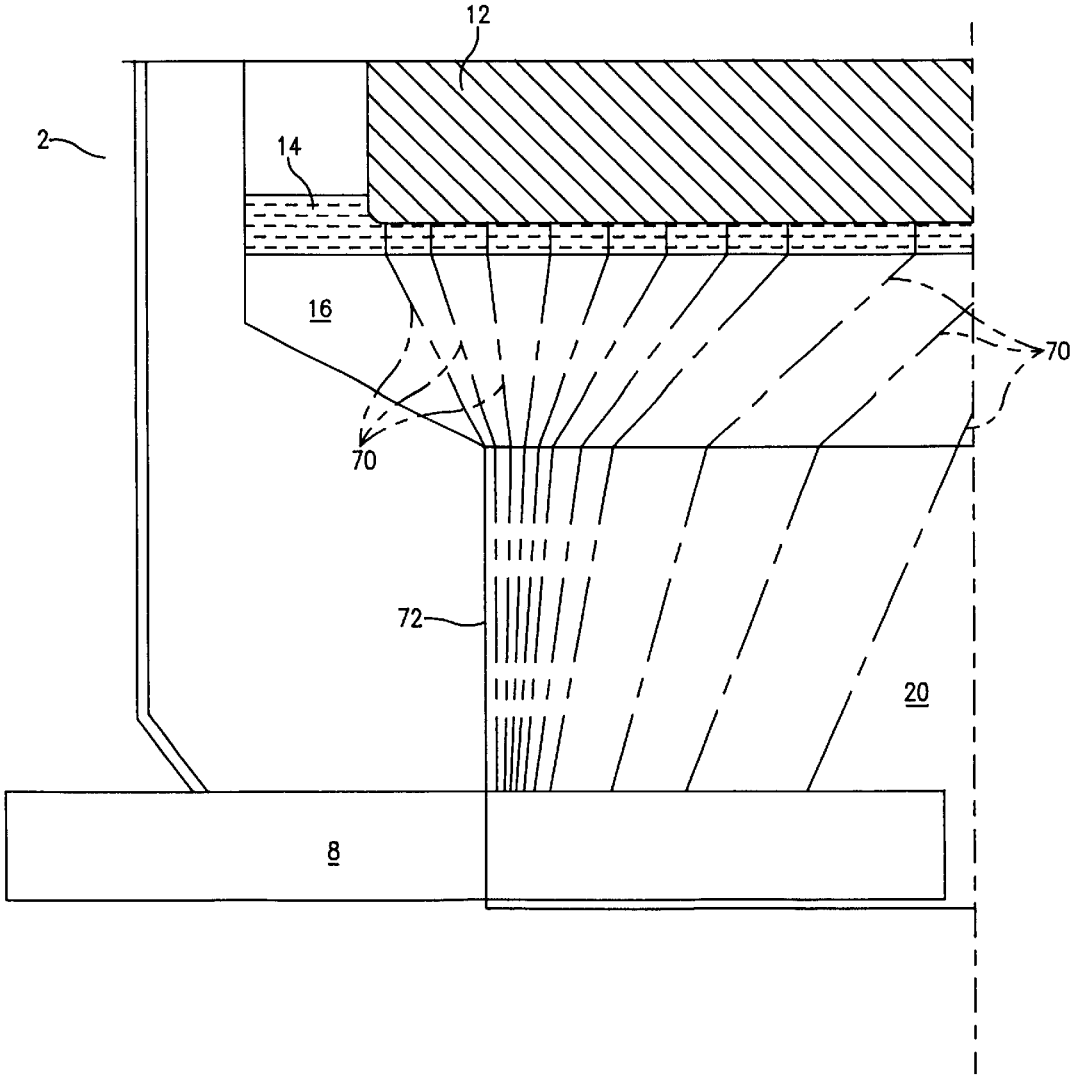
FIG. 7 is a graphical depiction of current paths shown along the length of the conventional cathode block.

Referring now to FIG. 7, a current gradient 70 is shown from anode 12 through the molten aluminum pad 16 along the length 1 of the cathode block 20 for cathode collector bar 8 of a pot 2. The highest current concentration is found directly over the steel collector bar 8 close to the outer end 72 of the block 20. The lowest current concentration is found in the middle of the block 20, at the inner collector bar ends. The current density profile 70 has been found empirically to match the inverse of the localized wear pattern of the carbon cathode block.

As the electrical conductivity of the carbon cathode block 20 is increased to reflect the change from low to high graphite content, the cathode current distribution 70 becomes more concentrated at the outer end 72 of the block 20. Higher peak currents are observed at the outer end 72 of the block. In a given pot at a given amperage, the localized wear rate will increase as cathodes of progressively higher graphite content are utilized.

Figure 8:
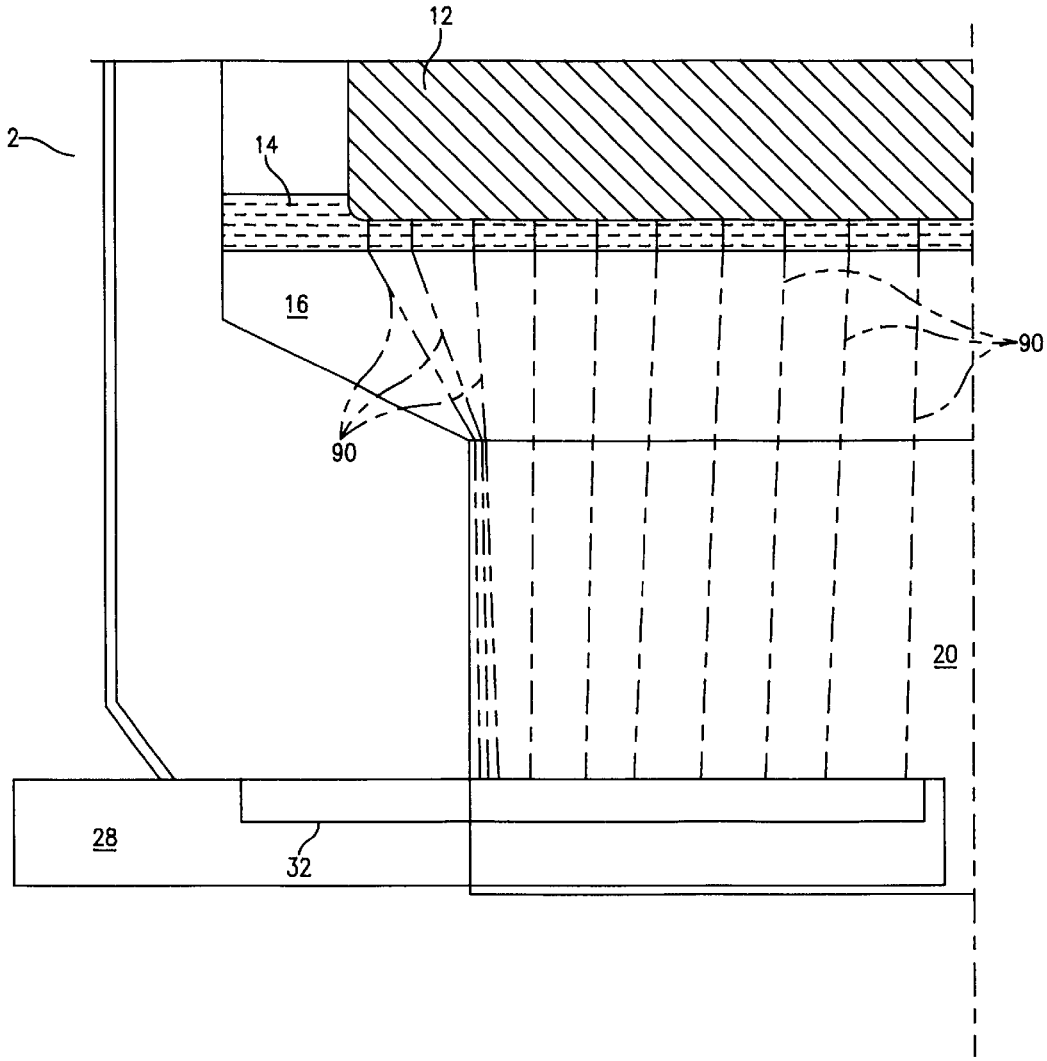
FIG. 8 is a graphical depiction of current paths shown along the length of the cathode block incorporating the novel cathode collector bar of the present invention.

Referring now to FIG. 8, a current gradient 90 is shown from anode 12 through the molten aluminum pad 16 along the length of the cathode block 20 for cathode collector bar 28 of a pot 4. The current concentration is more uniform over the copper insert collector bar 28 having copper insert 32 of the apparatus and method of the present invention.

The apparatus and method of the present invention provide a novel means and method to redirect current in the Hall-Heroult cell to reduce or eliminate inefficiencies attributable to non-uniform and/or horizontal electrical currents.

For a preferred current path within the pot, at a uniform thickness of cathode block material and a uniform contact resistance along the length of the collector bar/cathode block inter-face, the cathode current path and distribution is controlled by the differential between the electrical conductivity of the aluminum metal pad and the novel copper insert cathode collector bar of the present invention. With a high differential in favor of the aluminum pad, the preferred current path will be sideways through the metal pad toward the side of the pot and then down through the cathode to the collector bar, and out of the pot, showing the uneven distribution. By increasing the electrical conductivity of the novel copper insert collector bar and reducing the differential to match the aluminum pad or to favor the novel copper insert collector bar, the distribution is more uniform along the length of the bar.

The electrical conductivity differential between copper, steel, and aluminum are significant in determining and controlling pot cathode voltage drop (CVD) and heat balance.

At pot operating temperatures, copper has a significantly higher electrical conductivity of 45,835,000 $(\text{ohm-m})^{-1}$ compared to aluminum of 3,470,000 $(\text{ohm-m})^{-1}$. Copper at 45,835,000 $(\text{ohm-m})^{-1}$ also has a significantly higher electrical conductivity than that of steel of 877,800 $(\text{ohm-m})^{-1}$. We have observed that the inclusion of a 1 to 2 $\text{in}^2$ (6.5 to 12.9 $\text{cm}^2$) copper section in the form of 1"×1" (2.5 cm×2.5 cm) or 1.4"×1.4" (3.5×3.5 cm) section into an existing steel collector bar of 24 $\text{in}^2$ (155 $\text{cm}^2$) (6"×4", 15 cm×10 cm) section significantly increases the overall conductivity of the bar. The effect is to make the cathode current distribution more uniform and reduce localized wear rates.

Cathode voltage drop is reduced. In one embodiment, cathode voltage drop is reduced by up to 70 mV. The reduced voltage drop can be taken in reduced pot volts and a cost saving. Alternatively, the reduced voltage drop can be used to increase line load and tonnes of aluminum produced. In either case, the heat balance of the pot must be preserved to avoid unwanted cooling of the cathode mass which would result in cathode cracking and reduced pot life.

The ends of the collector bars protruding through the sides of the pot shell act as fins or heat sinks. The ends of the collector bars are an important part of the overall heat balance of the pot. Integrating copper into the design of the collector bar increases the heat lost from the pot. The length of the copper insert and particularly its extension beyond the end of the cathode block must be controlled carefully. We have found that to maintain a proper heat balance for the pot, the copper insert should not extend beyond the potshell, and the novel collector bar preferably is used in combination with additional insulation and other pot construction materials and techniques to offset the additional heat loss.

In the apparatus and method of the present invention, cathode voltage drop and heat loss changes are adjusted and controlled to prevent a reduction in the operating life of the pot. Pot bath operating temperatures range between 920° C. and 980° C. with extremes, in uncontrolled operation in excess of 1,150° C. A pure copper collector bar has a melting point of 1,085° C. In the apparatus and method of the present invention, we prefer to use only enough copper to provide the electrical conductivity change necessary. In the apparatus and method of the present invention, we prefer to encapsulate the copper in the collector bar. In the event that the melting point is exceeded, the copper will be retained within the bar, and the copper functionality will remain when the temperature excursion is corrected.

The cross sectional area of each collector bar preferably is about 24 $\text{in}^2$ (155 $\text{cm}^2$) with the copper insert occupying about 1 $\text{in}^2$ (6.5 $\text{cm}^2$). There is sufficient steel cross section to carry the full load with minimal increase in current density and IR heating, in the event that the copper insert does not carry current, e.g., for reasons such as copper melting and leaking out of the collector bar, a reduced or zero contact between the insert and the steel portion of the collector bar, or a build-up of an interfacial resistance layer between the two metals.

Encapsulation of the copper insert within the steel collector bar limits the amount of heat lost from the pot and retains the copper metal should the insert exceed its melting point during operation.

The differential in solid expansion rates of steel and copper between room and operating temperatures is accommodated by the small cross section of the copper insert (1"×1" (2.5 cm×2.5 cm)) and by machining tolerances in the range of 0.001–0.009 (0.0025–0.0229 cm) inch. The lengthwise direction has an allowance of 0.65 inches (1.7 cm) to provide for lengthwise expansion and to prevent the collector bar from bowing.

Diffusion of copper across the interface into the steel reduces the electrical conductivity of the copper insert and limits its effectiveness over time. At a cross section of copper of at least about 2 $\text{in}^2$ (12.9 $\text{cm}^2$), preferably at least about 1 $\text{in}^2$ (6.5 $\text{cm}^2$), the amount of time required for iron to penetrate the copper insert will not cause the iron to saturate the copper insert until the time approaching the end of the projected life of the pot. The maximum recorded interface values for diffusion during the experiments were 2.9% copper in steel and 3.5% iron in copper. These readings correspond reasonably well with the solid solution regions of the copper-iron phase diagram.

The diffusion effect on the electrical conductivity of copper showed that 0.4–0.6% iron diffusing into the copper insert reduces electrical conductivity to 40% of its original value. The electrical conductivity plot shows an asymptote around this value. In the worst case of complete penetration of iron into the copper to 0.4–0.6%, a 1"×1" (2.5 cm×2.5 cm) copper insert at 0.4–0.6% iron would still have a significant impact on the collector bar conductivity and therefore the cathode current distribution. A copper insert collector bar with a 1.4"×1.4" (3.5×3.5 cm) copper section, fully penetrated by 0.4–0.6% iron throughout the copper would have an overall conductivity of the composite collector bar very nearly equivalent to a copper insert collector bar with a pure 1"×1" (2.5 cm×2.5 cm) copper section.

The electrical resistivity of copper increases sharply on melting. The alloying rate of copper with steel also increases sharply on melting. In the event of a severe general or localized temperature excursion, there is the potential to exceed the melting point of 1,085° C. for pure copper or 1,095° C. for iron-contaminated copper at the levels found in the collector bar. At a 4.9% volume expansion, the pressure in a collector bar without a melting allowance varies from 1–6 MPa depending upon the degree of cover plate distortion. The copper insert is placed in the top portion of the collector bar to minimize potential of leakage, and the cover plate should not be allowed to distort and interfere with the cathode electrical connection. To avoid this, an additional machined slot of sufficient volume is used to accommodate any increase in volume. The slot is located centrally along the length of the underside of the mild steel plate. Under operating conditions, liquid copper will penetrate any gap between the side of the machined slot in the collector bar and the side of the top plate through capillary action due to its ability to wet mild steel. This will be prevented by preparing the vertical mild steel faces of the plate and just the adjacent portion of the vertical face of the machined slot with a suitable non-wetting agent such as a graphite paste prior to welding the cover plate into position. As the collector bar cools, the liquid copper will drain from the slot in the mild steel plate and resolidify in the collector bar slot, and the overall conductivity will not be destroyed. In another embodiment, the length of the slot can be increased or the length of the copper insert can be decreased to allow sufficient volume within the first slot to accommodate the increased volume associated with the melting of the copper insert. Alternatively, the pot also can be removed from operation when the operating temperature of the collector bar approaches the melting point of the copper insert.

Pressure relief is provided for air trapped within the collector bar structure during fabrication. A lengthwise thermal expansion and a melting expansion allowance contain air which will expand when heated to pot operating temperatures. Pressure relief is provided by providing an incomplete top plate weld thus by providing a hole 85 (FIG. 5) in the top plate weld at the coldest part of the copper insert, i.e., in the part of the collector bar that extends beyond the cathode block towards the external bus bar. In another embodiment, pressure relief is provided by drilling a hole from the upper surface of the collector bar through to the slot at the coldest part of the insert, i.e., in the part of the collector bar that extends beyond the cathode block towards the external bus bar.

Three series of empirical tests were run. A first test monitored the condition of the copper/steel interface and indicated the differential in overall resistance between the copper insert piece and an all steel control. A second test determined the overall resistance of a test piece of similar construction to the novel copper insert collector bar, against an all steel control. The first and second tests were run over time at normal pot operating temperatures. A third test monitored overall electrical resistance over time at temperatures up to and exceeding of the melting point of copper.

EXAMPLE I

A first test placed a test piece 10" (25 cm) long of 6"×4" (15 cm×10 cm) collector bar, having an 8" (20 cm) long 1"×1" (2.5 cm×2.5 cm) copper insert into a furnace at 930–950° C. for 7–8 days. A 100 Amp DC current was applied across the test section in a way to ensure all current exited through the copper insert. The overall resistance was monitored.

No significant deterioration was observed in interface condition for the duration of the test.

A 1:3 ratio was observed in overall resistance for the copper insert sample relative to the all steel control sample.

The condition of the copper/steel interface as well as the extent of copper and iron diffusion were checked. No reaction compounds or scale (oxide) build-up was observed at the interface.

Visible inclusions were analyzed in both original and tested sections. Initial copper oxide inclusions in the original copper were converted to iron oxide. The initial steel inclusions remained unaffected. The test sections were sectioned, and the copper and steel were observed to be tightly bonded indicating excellent operational contact.

EXAMPLE II

In a second test, samples were constructed such that the copper insert was fully encapsulated in steel. The current source was connected by current distribution plates on either end of the unit so that there could be no direct contact between the current source and the copper insert. Test sections were held at 930–950° C. for 7–8 days while monitoring the overall resistance. Severe end effects were observed, resulting in measured values for the copper insert sections close to those of the all mild steel control section. The difference in readings between the copper insert and all mild steel sections was determined to be significant. The magnitude of the difference depended on the orientation of the copper insert, top surface of the bar versus bottom surface of the bar, with respect to the incoming current. The section with the copper insert in the top surface of the bar gave the best result.

Because of the size of the available furnace and the measurement technique used, the test sections were restricted to 9" (23 cm) in length. A computer model was used to verify the test readings and demonstrate the impact of end effects on the test section design.

EXAMPLE III

In a third test, the same arrangement was used as discussed for the second test series of Example II. The variation took the samples up to 1,085–1,125° C. rather than to 930–950° C. The preferred specified orientation of the copper insert top and bottom of the bar was determined and confirmed. The preferred specified size of the melt expansion slot was determined.

Variations of the apparatus and method of the present invention are possible without departing from the spirit and scope of the apparatus and method of the present invention. For example, while the above detailed description of our invention relates to a particularly preferred cathode collector bar and copper insert each having a rectangular cross-section, the collector bar and the copper insert may each have a circular, oval, triangular, or other cross-sectional shape without departing from the spirit and scope of the invention.

The foregoing detailed description has been for the purpose of illustration. Modifications and changes can be made without departing from the spirit and scope of the apparatus and method of the present invention. Alternative or optional features described as part of one embodiment can yield another embodiment. Two named components can represent portions of the same structure. Various alternative process and equipment arrangements can be employed. While specific embodiments of the apparatus and method of the present invention have been described, the scope of the apparatus and method of the present invention is not intended to be limited only to those specific embodiments, but the scope of the apparatus and method of the present invention is defined by the following claims and all equivalents to the following claims.

What is claimed is:

1. An electrolytic reduction cell for the production of aluminum, comprising:

a cell having a first cell wall, a second cell wall opposite said first cell wall, and a cell center between said first cell wall and said second cell wall;

a first external bus bar external to said first cell wall;

at least one anode;

a carbonaceous cathode block positioned below said anode;

a ferrous cathode collector bar positioned in electrically conductive contact with said cathode block, extending from said first cell wall to at least toward said cell center, and electrically connected to said first external bus bar; and a copper insert inside said cathode collector bar, said copper insert having a first portion spaced apart from an external end of said cathode collector bar toward said cell center and terminating at a first interior end between said first cell wall and said cell center.

2. An electrolytic reduction cell as set forth in claim 1, wherein said copper insert resides in a slot in said collector bar, said slot having a dimension of 0.25–0.97 inches (0.635–2.464 cm) or 0.37–1.44% more than a length dimension of said copper insert.

3. An electrolytic reduction cell as set forth in claim 1, further comprising a melting allowance slot.

4. An electrolytic reduction cell as set forth in claim 1, wherein said copper insert is formed by machining a slot having a tolerance of 0.001–0.009" (0.0025–0.0229 cm) or 0.1–0.9% of the copper section in the width direction.

5. An electrolytic reduction cell as set forth in claim 1, wherein said first interior end of said copper insert portion is located about 1.25 inches (3.18 cm) from said cell center to about 10 inches (25.4 cm) toward said first cell wall.

6. An electrolytic reduction cell as set forth in claim 1, wherein said copper insert has a cross-sectional area of between about 0.042 to about 0.250 times the cross-sectional area of said cathode collector bar.

7. An electrolytic reduction cell as set forth in claim 6, wherein said copper insert has a cross-sectional area of between about 0.042 to about 0.125 times the cross-sectional area of said cathode collector bar.

8. An electrolytic reduction cell as set forth in claim 7, wherein said copper insert has a cross-sectional area of about 0.084 times the cross-sectional area of said cathode collector bar.

9. An electrolytic reduction cell as set forth in claim 1, wherein said copper insert has a cross-sectional area of about two square inches (13 square cm).

10. An electrolytic reduction cell as set forth in claim 1, further comprising a second copper insert in a second cathode collector bar located and extending between said cell center toward said second cell wall.

11. An electrolytic reduction cell as set forth in claim 1, wherein said cathode collector bar extends from outside said first cell wall to outside said second cell wall.

12. An electrolytic reduction cell as set forth in claim 1, comprising a plurality of cathode collector bars.

13. An electrolytic reduction cell as set forth in claim 1, comprising two carbonaceous cathode blocks separated by rammed carbonaceous paste.

14. An electrolytic reduction cell as set forth in claim 1, wherein said cathode collector bar further comprises a top plate welded to a top side of said cathode collector bar to contain said copper insert.

15. An electrolytic reduction cell as set forth in claim 14 wherein said top plate is 0.5 inch (1.27 cm) thick and is ferrous.

16. An electrolytic reduction cell as set forth in claim 14 wherein said top plate, said top plate weld, and said cathode collector bar define a pressure relief hole.

17. An electrolytic reduction cell as set forth in claim 14 wherein said copper insert and said top plate are parallel to a longitudinal axis of said cathode collector bar.

18. A method of producing aluminum in an electrolytic reduction cell, comprising:

providing a cell having a first cell wall, an opposite second cell wall, and a cell center between said first cell wall and said second cell wall;

providing a first external bus bar external to said first cell wall;

providing at least one anode;

providing a carbonaceous cathode block positioned below said anode;

providing a ferrous cathode collector bar having a longitudinal axis positioned in electrically conductive contact with said cathode block and extending from said first cell wall to at least near to said cell center and electrically connected to said first external bus bar;

said cathode collector bar having a copper insert, said copper insert having a first portion spaced apart from an external end of said cathode collector bar toward first cell wall and terminating at a first interior end between said first cell wall and said cell center;

and passing an electric current between said anode and said cathode block, said copper insert providing a more uniform cathode current distribution.

19. A method of producing aluminum in the electrolytic reduction cell of claim 1, comprising passing an electric current between said anode and said cathode block to provide a more uniform cathode current distribution.

20. A method of producing aluminum in an electrolytic reduction cell as set forth in claim 19, wherein said copper insert resides in a slot in said collector bar, said slot having a dimension of 0.25–0.97 inches (0.635–2.464 cm) or 0.37–1.44% more than a length dimension of said copper insert.

21. A method of producing aluminum in an electrolytic reduction cell as set forth in claim 19, further comprising providing a melting allowance slot in said cathode collector bar.

22. An electrolytic reduction cell for the production of aluminum, comprising:

a cell having a first cell wall, a second cell wall opposite said first cell wall, and a cell center between said first cell wall and said second cell wall;

a first external bus bar external to said first cell wall;

at least one anode;

a carbonaceous cathode block positioned below said anode;

a ferrous cathode collector bar, having a top side and a bottom side, positioned in electrically conductive contact with said cathode block, extending from said first cell wall to at least toward said cell center, and electrically connected to said first external bus bar;

a copper insert inside said cathode collector bar, said copper insert having a first portion spaced apart from an external end of said cathode collector bar toward said cell center and terminating at a first interior end between said first cell wall and said cell center, wherein said copper insert cross-section is between about 0.042 to about 0.125 times the cross-sectional area of said cathode collector bar;

a melting allowance slot having sufficient volume to accept an increased copper volume associated with melting of said copper insert;

a thermal expansion allowance in said collector bar, said thermal expansion allowance having a dimension of 0.25–0.97 inches (0.635–2.464 cm) or 0.37–1.44% more than a length dimension of said copper insert; and a top plate welded to said top side to contain said copper insert.

* * * * *

UNITED STATES PATENT AND TRADEMARK OFFICE

CERTIFICATE OF CORRECTION

PATENT NO. : 6,231,745 B1
DATED : May 15, 2001
INVENTOR(S) : Howard Dalton et al.

It is certified that error appears in the above-identified patent and that said Letters Patent is hereby corrected as shown below:

Column 1,
Line 46, "The (electrode potential)" should read -- The Eo' (electrode potential) –

Column 2,
Line 12, "lose of" should read -- loss of --;
Line 46, "volt monograms" should read -- voltammograms --.

Column 5,
Line 55, "can successful" should read -- can successfully --;
Line 59, "Differential" should read -- differential --.

Column 7,
Line 51, "(Bath" should read -- (Bath) --;
Line 64, "SMMO" should read -- sMMO --;
Line 66, "potentials values" should read -- potential values --.

Column 8,
Line 20, "SMMO" should read -- sMMO --;

Column 9,
Line 2, "(II) B complexes" should read -- (II).B complexes --.

Column 10,
Line 30, "of methanol to" should read -- of methane to --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,231,745 B1
DATED : May 15, 2001
INVENTOR(S) : Graham E. Homely, et al.

It is certified that error appears in the above-identified patent and that said Letters Patent is hereby corrected as shown below:

This certificate supersedes certificate of correction issued November 27, 2001, the number was erroneously mentioned and should be deleted since no certificate of correction was granted.

Signed and Sealed this

Twenty-ninth Day of January, 2002

*Attest:*

*Attesting Officer*

JAMES E. ROGAN
*Director of the United States Patent and Trademark Office*